US007241169B1

(12) United States Patent
Yang

(10) Patent No.: US 7,241,169 B1
(45) Date of Patent: Jul. 10, 2007

(54) ADAPTER FOR POWER SUPPLY

(76) Inventor: Hsien-Lin Yang, 6F, No. 3, Lane 68, San Min Road, Sung Shan District, Taipei City (TW)

( * ) Notice: Subject to any disclaimer, the term of this patent is extended or adjusted under 35 U.S.C. 154(b) by 0 days.

(21) Appl. No.: 11/469,883

(22) Filed: Sep. 4, 2006

(51) Int. Cl.
*H01R 29/00* (2006.01)

(52) U.S. Cl. ..... 439/518; 439/172; 439/906; 439/956

(58) Field of Classification Search ..... 439/171–173, 439/218, 518, 956, 166, 906
See application file for complete search history.

(56) References Cited

U.S. PATENT DOCUMENTS 3,025,486 A * 3/1962 Henry ..... 439/103
4,973,827 A * 11/1990 Nozaki ..... 219/521
5,613,863 A * 3/1997 Klaus et al. ..... 439/131
6,669,495 B2 * 12/2003 Philips et al. ..... 439/170
6,845,023 B2 * 1/2005 Philips et al. ..... 363/132
7,118,399 B1 * 10/2006 Wen et al. ..... 439/166

* cited by examiner

*Primary Examiner*—Tho D. Ta
(74) *Attorney, Agent, or Firm*—Leong C. Lei

(57) ABSTRACT

An adapter for power supply is disclosed. The adapter comprises a body containing a peg module connected a connector of a plug, characterized in that one side of the body of the adapter is a common socket engaged with an engaging slot formed on the housing, the top portion of the engaging slot is a peg slot for the peg element at the bottom of the connector to align with the peg module at the interior of the body. The peg module is positioned within the interior of the body and the connector of various specification has a common plug for connection with a protruding peg of the adapter.

1 Claim, 3 Drawing Sheets

ADAPTER FOR POWER SUPPLY

BACKGROUND OF THE INVENTION (a) Technical Field of the Invention

The present invention relates to adapter, and in particular, to a power source adapter with connectors allowing different types of electrical plugs used in different regions.

(b) Description of the Prior Art

Adapters are used for electrical devices for current, a voltage conversion or changing, especially these adapters are used in notebook computer, mobile phones, digital cameras, PDA. These devices use adapters to provide operation or to recharging of batteries. Conventional adapters normally provide a fixed type of adapting function of power supply and drawback of these adapters is that they cannot be used in different regions of the world where different type of sockets or plugs are used. Another shortcoming of the available adapters is that these adapters normally have a significant size which occupies space when it is carried in a bag containing the electrical device. Accordingly, it is an object of the present invention to provide a power source adapter which has small in size, and conveniently stored when it is not in use.

SUMMARY OF THE INVENTION

The primary purpose of the present invention is to provide an adapter for power supply having a housing, a body containing a peg module connected to a connector of a plug, characterized in that one side of the body of the adapter is a common socket engaged with an engaging slot formed on the housing, the top portion of the engaging slot is a peg slot for the peg element at the bottom of the connector to align with the peg module at the interior of the body, the peg module is positioned within the interior of the body of the adapter and the peg module is aligned with peg slot, and comprises a spring, a press button and an engaging element, wherein the spring is restricted by a capped shaft and the press button is interlinked with the engaging element as one unit, and the depress button is aligned with a through hole provided on the top housing such that the depress button protrudes beyond the top housing and the depress button is used to release or to engage with the engaging element; and the connector having a bottom is provided with a common plug and one side of the connector is a protruded peg which is aligned with the peg slot, and the engaging element of the peg module is engaged and positioned with the protruded peg.

Yet still another object of the present invention to provide an adapter for power supply, wherein the adapter is compatible to electrical appliance in all regions in the world.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the description embodiments may be made in the function and arrangement of the elements described without departing from the scope of the invention as set forth in the appended claims.

Figure 1:
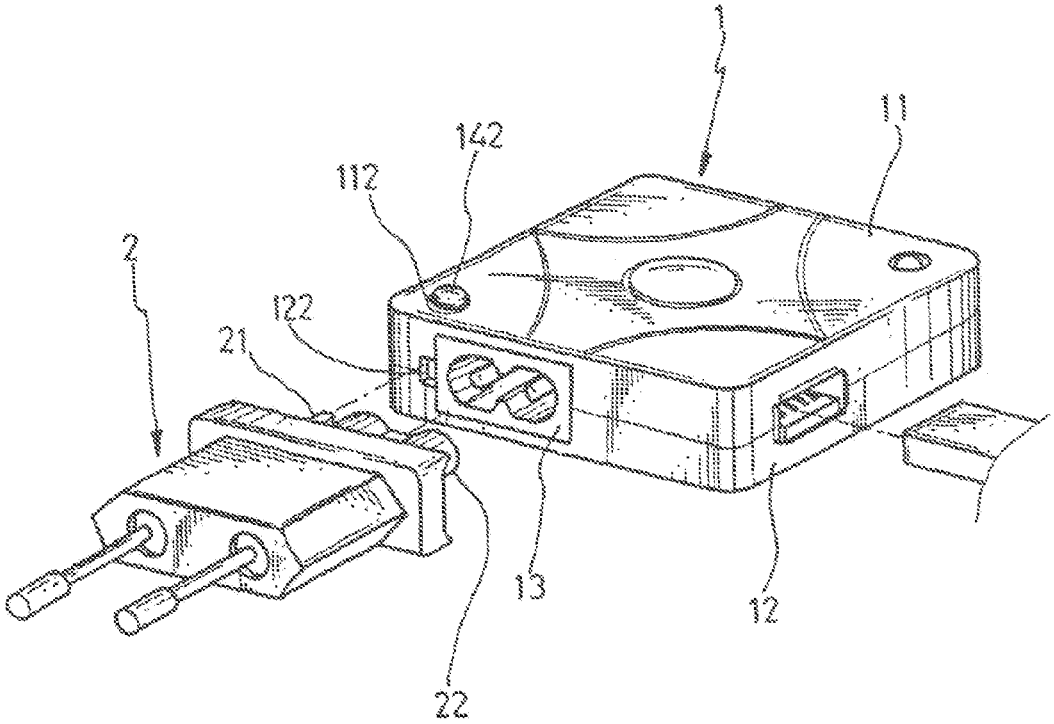
FIG. 1 is perspective exploded view of the adapter for a power supply in accordance with the present invention.
Figure 2:
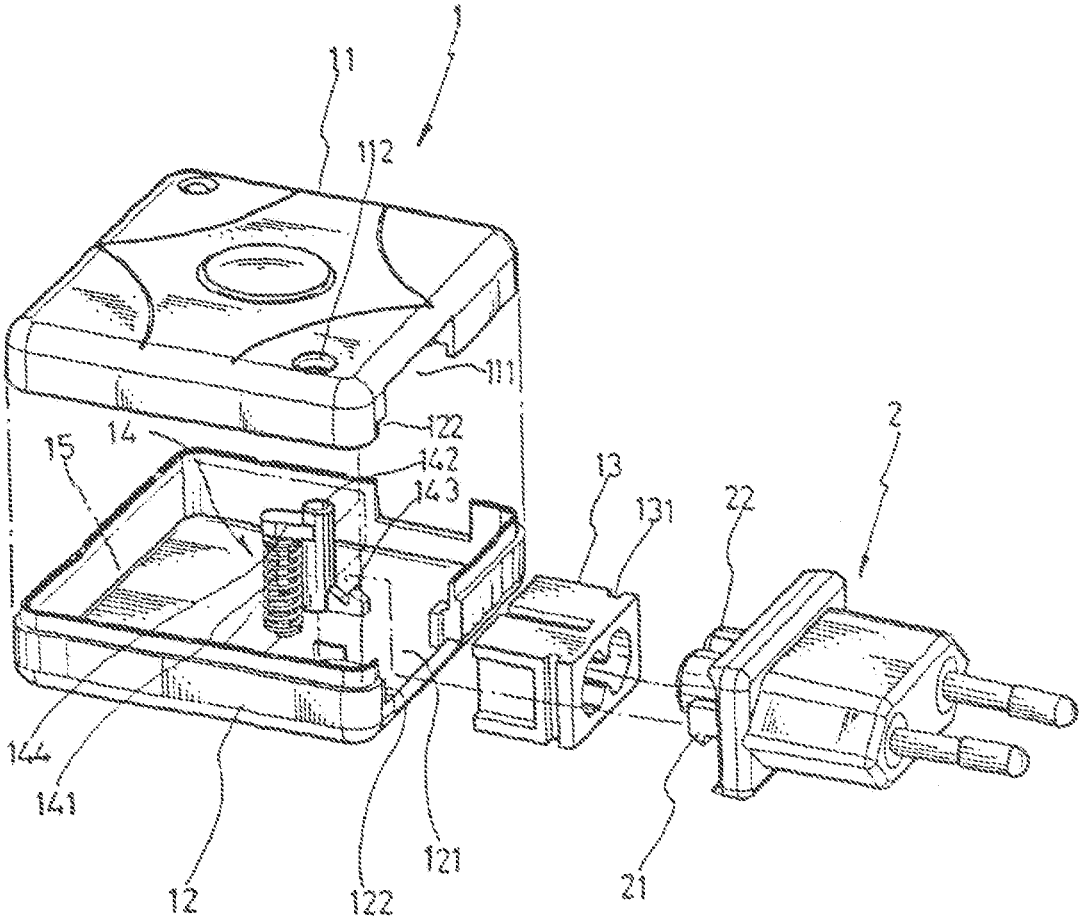
FIG. 2 is an exploded schematic view of the adapter in accordance with the present invention.
Figure 3:
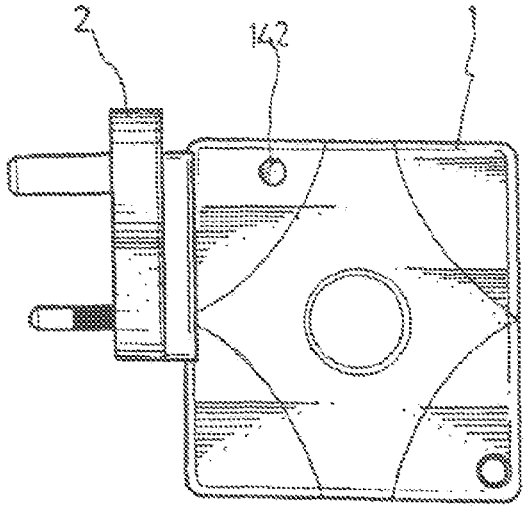
FIG. 3 is a first working view of the present invention.
Figure 4:
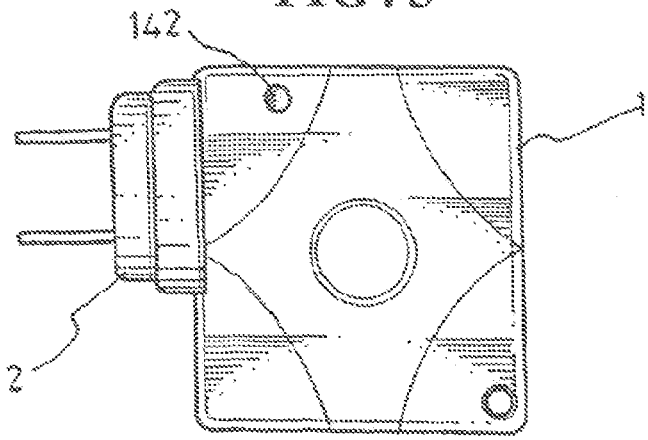
FIG. 4 is a second working view of the present invention.
Figure 5:
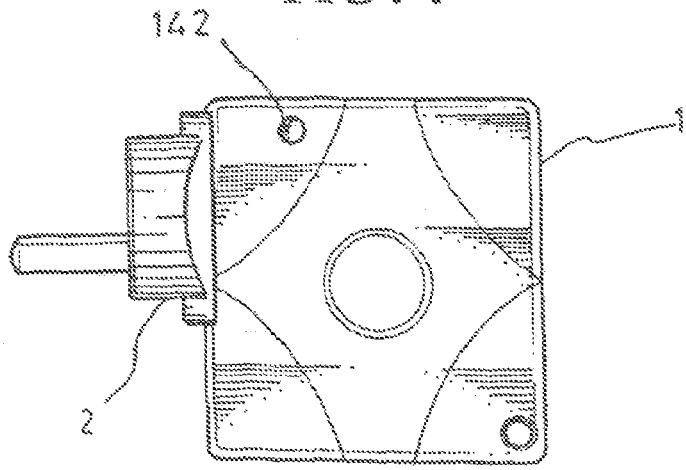
FIG. 5 is a third working view of the present invention.

Referring to FIGS. 1 and 2, the present invention relates to an adapter having a body 1 and a connector 2 with multiple specifications. In accordance with the preferred embodiment of the present invention, the body 1 includes a top housing 11, a bottom housing 12, a common socket 13, a peg module 14 and an electronic module 15. The body 1 provides connection with different types of connectors 2.

As shown in FIG. 2, there is shown an exploded view of the adapter of the present invention. One lateral side the top housing 11 is formed with an engaging slot 111 and one lateral side of the bottom housing 12 has an engaging slot 121. A peg slot 122 is formed at the upper section of the slots 111, 121. The slots 111, 121 provide a space for a common plug 13 to be inserted. The common socket 13 has two opposite grooves 131 engaged with two edges of the engaging slots 111 and 121. The common socket 13 is firmly secured at the slots 111, 121. The peg slot 122 is for receiving a peg element 21 of the connector 2 and the peg element 21 is in engagement with the peg module 14 within the interior of the body 1.

The peg module 14 is limited to move within the space between the top and bottom housings 111 and 121 and the peg nodule 14 is aligned with the peg slot 122. The peg module 14 comprises a spring 141, a press button 142, an engaging element 143, and a capped shaft 144. The spring 141 is put over the capped shaft 144 and the press button 142 is interlinked with the engaging element 143 as one unit. The press button 142 is aligned with a through hole 112 provided on the top housing 11 such that the press button 142 is partially exposed beyond the top housing 11. When the press button 142 is depressed, the spring 141 is compressed and the engaging element 143 moves from its engaging position to release the peg element 21 at the bottom of the connector 2.

The bottom of the connector 2 of different plug specification is different from one another. A common plug 22 is needed in order to adapt the common socket 13 of the body of the adapter, and one side of the bottom portion of the body 1 has a protruded peg element 21. The peg element 21 is aligned with the peg slot 122, and the engaging element 143 at the interior of the body 1 of the adapter forms into engagement. Thus, a quick installation is completed. To release the body 1 from the connector 2, the press button protruded from the top housing 11 is depressed, the peg element 143 is dislocated and thus, the connector 2 is removed.

It will be understood that each of the elements described above, or two or more together may also find application in other types of methods differing from the type described above.

While certain novel features of this invention have been shown and described and are pointed out in the annexed claim, it is not intended to be limited to the details above, since it will be understood that various omissions, modifications, substitutions, substitutions and changes in the forms and details of the device illustrated and in its operation can be made by those skilled in the art without departing in any way from the spirit of the present invention.

I claim:

1. An adapter for power supply comprising:

a body including a top housing, a bottom housing, a common socket, and a peg module, said top housing having a lateral side formed with a first engaging slot, said bottom housing having a lateral side formed with a second engaging slot, said first and second engaging slots providing a space for said common socket to be inserted, said first and second engaging slots being formed with a peg slot;

said common socket having two opposite grooves engaged with two edges of said first and second engaging slots, said common socket having two opposite grooves engaged with two edges of said first and second engaging slots;

said peg module comprising a spring, a press button, an engaging element and a capped shaft, said spring being put over said capped shaft, said press button being interlinked with said engaging element as one unit, said press button extending through a hole on said top housing thereby partially exposing beyond said top housing; and a connector having a peg element aligned with said peg slot so that when said connector is plugged into said common socket, said peg element will go through said peg slot into said body to engage with said engaging element of said peg module;

whereby when said press button is depressed, said spring is compressed and said engaging element moves from an engaging position to release said peg element of said connector.

* * * * *